US006623079B2

(12) United States Patent
Gregory

(10) Patent No.: US 6,623,079 B2
(45) Date of Patent: Sep. 23, 2003

(54) CHAIR

(76) Inventor: Peter G. G. Gregory, 2205-127 Kent Street, Sydney, New South Wales, 2000 (AU)

( * ) Notice: Subject to any disclaimer, the term of this patent is extended or adjusted under 35 U.S.C. 154(b) by 6 days.

(21) Appl. No.: 09/888,039

(22) Filed: Jun. 22, 2001

(65) Prior Publication Data

US 2001/0030457 A1 Oct. 18, 2001

Related U.S. Application Data

(63) Continuation-in-part of application No. 09/409,024, filed on Sep. 29, 1999, now Pat. No. 6,254,190.

(51) Int. Cl.[7] ..... A47C 7/00
(52) U.S. Cl. ..... 297/440.11; 297/452.38
(58) Field of Search ..... 297/440.11, 452.1, 297/452.38, 452.13, 452.18, 284.1, 463.2, 440.1, 452.56, 452.59, 452.62

(56) References Cited

U.S. PATENT DOCUMENTS 2,374,801 A * 5/1945 Bolick, Sr.
5,318,348 A * 6/1994 Hess
5,503,455 A * 4/1996 Yang
5,662,383 A * 9/1997 Hand
5,762,403 A * 6/1998 Robinson

* cited by examiner

*Primary Examiner*—Milton Nelson, Jr.
(74) *Attorney, Agent, or Firm*—Jack Shore

(57) ABSTRACT

A chair that enables the occupant to be seated with correct posture. The chair (10) has a seat assembly (12) for supporting a person sitting on the chair. The seat assembly includes a seat frame (42) and sheet material (32) that is stretched and secured in place relative to the frame to support the weight of a person sitting on the chair by tension forces in the sheet material. The sheet material (32) includes a bead (58) along an edge thereof, the seat frame including an extruded section with a recess (56) into which the bead (58) is located. The bead (58) is secured in the recess (56) by a retaining member (60) so as to secure the sheet material (32) under tension to the seat frame (42).

18 Claims, 5 Drawing Sheets

CHAIR

This application is a continuation-in-part of application Ser. No. 09/409,024 filed Sep. 29, 1999, now U.S. Pat. No. 6,254,190.

TECHNICAL FIELD

The present invention relates to chairs, and in particular to a chair which enables the occupant to be seated with correct posture. The invention also provides a novel method of assembly for a chair.

BACKGROUND ART

An occupant of a chair seated with correct posture should have his or her back relatively straight with the spine having a slight bow at its lower portion. Correct posture can prevent and alleviate back pain. To this end, chair designs have been continually refined in order to ensure that the occupant is seated with the correct posture to minimise and hopefully eliminate back pain. While the perfect chair has yet to be invented substantial strides have been made and continue to be made.

Various attempts have been made to design a chair that will ensure correct posture and one such chair has been invented by the subject inventor and is disclosed in U.S. Pat. No. 4,889,387. The chair in question, while very satisfactory, is sufficiently costly that it does not lend itself to being used in chair that is priced sufficiently low to reach a mass market and thus provide the desired benefit to a wide range of consumers. In essence there has long been a need to provide a relatively low cost chair that will maintain a sitter in the desired correct posture while resisting forward movement of the sitter from the seat.

It is therefore an object of the present invention to overcome or ameliorate at least one of the disadvantages of the prior art, or to provide a useful alternative.

SUMMARY OF THE INVENTION

In accordance with a first aspect of the invention there is provided a chair having a seat assembly for supporting a person sitting on the chair, the seat assembly including:

a seat frame;

sheet material that is stretched and secured in place relative to said frame to support the weight of a person sitting on the chair by tension forces in the sheet material;

said sheet material including a bead along an edge thereof, said seat frame including an extruded section with a recess into which said bead is located, wherein said bead is secured in said recess by means of a retaining member so as to secure said sheet material under tension to said seat frame.

Preferably the retaining member for securing the bead portion within said recess includes a tongue portion which is shaped and sized so as to locate within the recess and retain the bead in place in said recess. It is further preferable that the retaining member is of constant cross-sectional profile along its length. Preferably the retaining member is substantially T-shaped. It is also preferable that the retaining member is extruded.

Preferably the extruded section of the seat frame is made from aluminium or aluminium alloy.

Preferably the sheet material includes a bead along at least a pair of opposing edges, said bead being located and retained in said recess of said extruded section to secure said sheet material in place relative to said frame. Preferably the sheet material is woven. It is further preferable that the sheet material is woven from polyester elastomeric fibres.

In accordance with a second aspect of the invention there is provided a method of securing a sheet material to a seat frame so as to form a support portion, said sheet material including a bead along an edge thereof, said seat frame including an extruded section with a recess into which said bead is located, the method comprising steps of stretching the sheet material to the desired length in order that said bead may be located in said recess, locating said bead in said recess, and securing the bead in said recess by means of a retaining member so as to secure said sheet material under tension to said seat frame.

Preferably the sheet material is located in one or more clamps and subsequently stretched to the desired length in order to locate said bead portion in said recess.

Preferably, the sheet material includes a bead along at least a pair of opposing edges, the bead being located and retained in the recess of the extruded section so as to secure the sheet material in place relative to said frame. Preferably, the bead is retained in the recess by a retaining member which includes a tongue adapted to locate within the recess and thereby retain the bead in the recess.

Preferably, the sheet material is woven. In one preferred embodiment the front support portion is woven with more fibres per inch than said rear support portion. In one preferred embodiment the sheet material is woven from polyester elastomeric fibres.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

The present invention provides a novel chair construction that is capable of having all the desired movements including seat height and tilt adjustment, synchronised back and seat angle adjustment and incorporates a novel seat construction that provides posture support. In a preferred embodiment the support portion of the seat is composed of sheet material, preferably woven fabric or mesh material, having a front support portion that is more resistant to deformation than its rear support portion. In one embodiment the front portion is woven with more fibres per inch than the rear support portion. In another embodiment, the front support portion is stretched to a greater extent than the rear support portion such that the front support portion is less compliant than the rear support portion. The front support portion and the rear support portion may be formed from a unitary sheet material. A sheet with the desired dual compliance may be formed of separate sections of fibre that are woven together to form a single fabric. Prior to installation in the seat frame the sheet is stretched and while in its stretched condition is inserted into recesses in the seat frame and maintained in the stretched condition by suitable retaining members.

BRIEF DESCRIPTION OF THE DRAWINGS

A preferred embodiment of the invention will now be described, by way of example only, with reference to the accompanying drawings in which.

DESCRIPTION OF THE INVENTION

Figure 1:
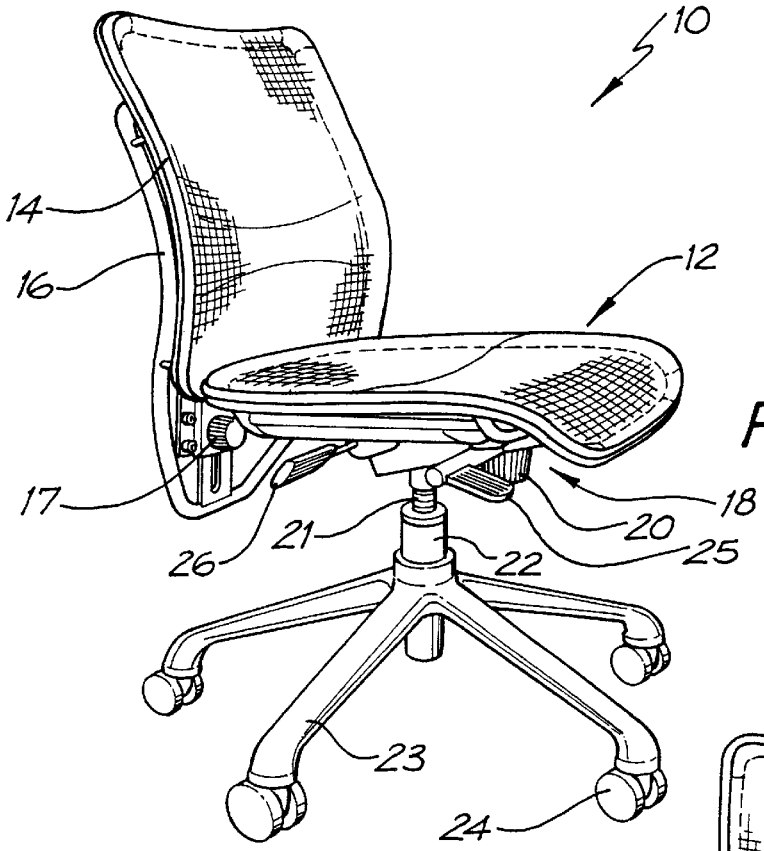
FIG. 1 is a perspective view of a chair incorporating the present invention.

Referring to FIG. 1 a perspective view of a chair 10 incorporating the present invention is illustrated, and it is to be noted that the illustrated chair is merely representative of a chair that would employ the novel seat construction of the invention. While various adjustment features will be disclosed and referred to these features are typically common to chairs of this type and are not essential to the invention. Such features are described and illustrated so that one may have a complete understanding of the operation and construction of a chair and the environment in which the invention is used.

The chair 10 of FIG. 1 includes a seat assembly 12 for supporting a person when seated in the chair, a back section 14 and a back support 16 for the back section 14. There is provided an adjustable connection 17 to provide for movement of the back section 14 and support 16 relative to the seat assembly 12. A seat support structure 18 supports the seat assembly 12, back section 14 and back support 16 relative to a seat column 21 that is located in a tubular support 22. The tubular support 22 is affixed to a base comprising a leg assembly 23 that is supported on wheels 24. The seat support structure also includes a tension adjustment 20 for the seat back section 14 and back support 16, a height adjustment mechanism 25 and a seat tilting mechanism 26.

Figure 5:
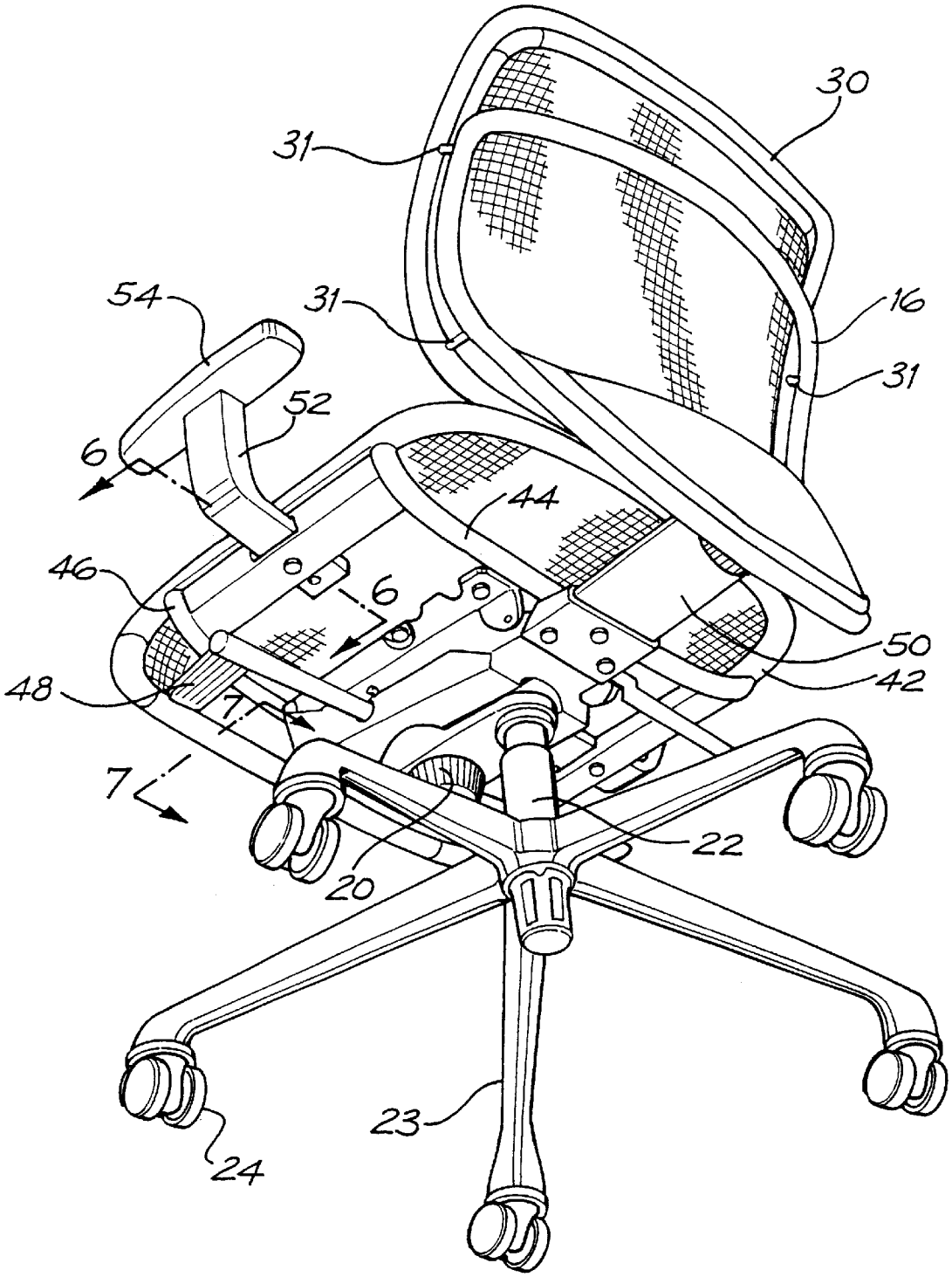
FIG. 5 illustrates the undersection of the chair.

The back section 14 comprises a back frame 30 and a back fabric 28 that is suitably secured in place under tension to the frame 30 so as to support the back of a person when seated in the chair. The back section 14 is connected to the back support 16 by means of connectors 31 as shown in FIG. 5.

Figure 3:
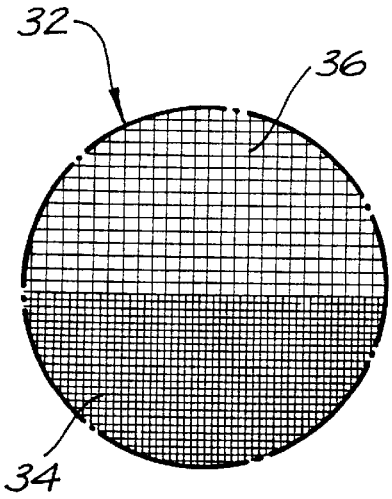
FIG. 3 illustrates the fabric construction of the portion circled in FIG. 2.
Figure 2:
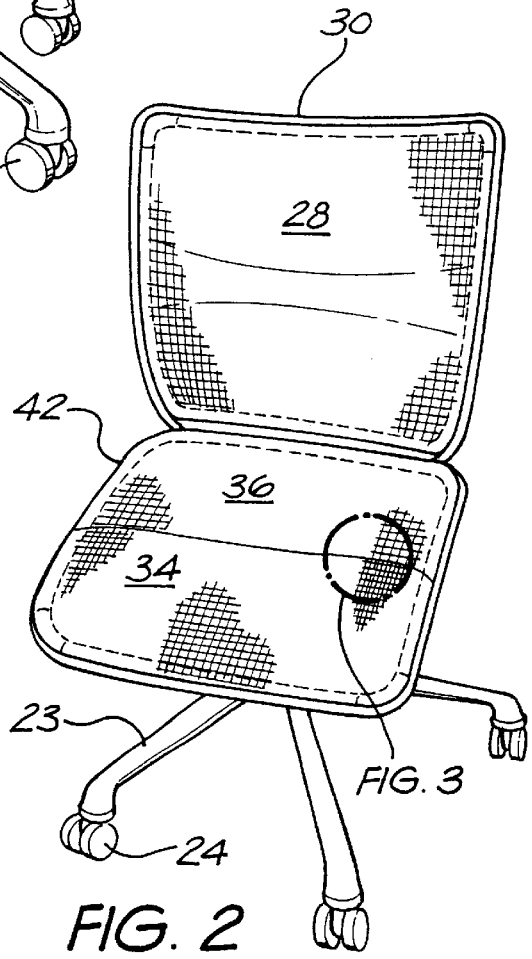
FIG. 2 is a front view of the chair.
Figure 6:
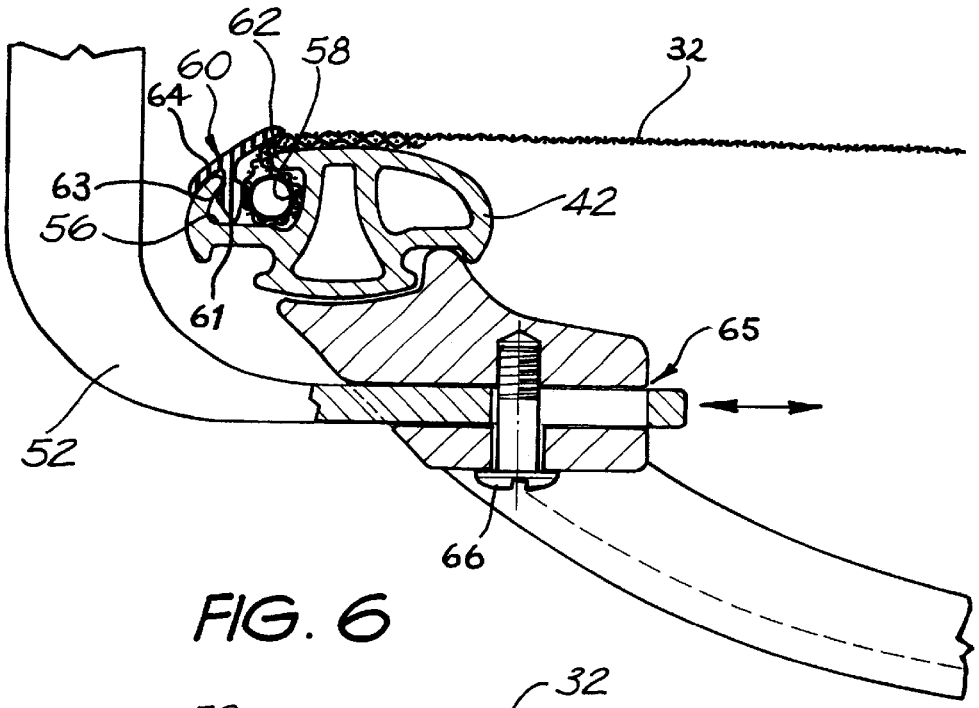
FIG. 6 is a view taken along line 6—6 of FIG. 5.
Figure 7:
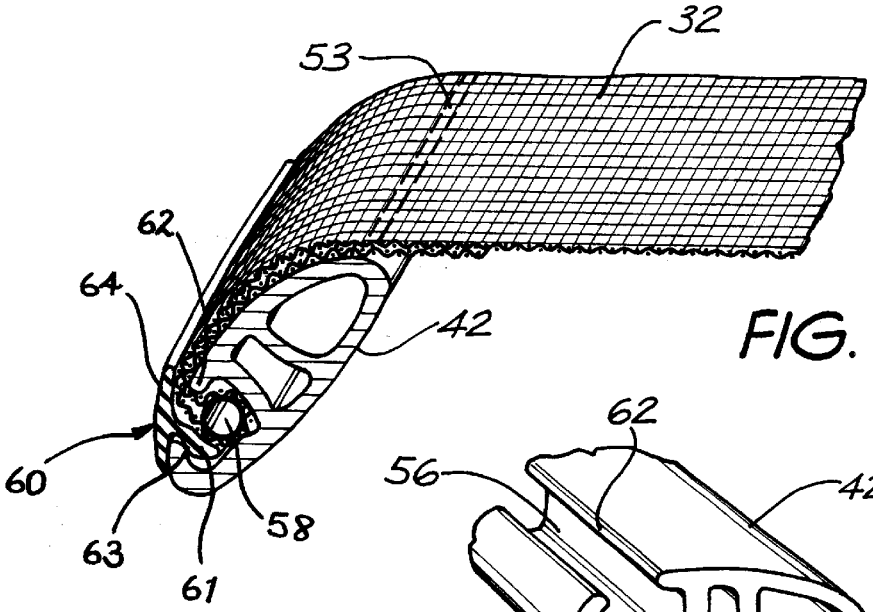
FIG. 7 is a view taken along 7—7 of FIG. 5.

FIGS. 2 and 3 illustrate the sheet 32 in place and its construction, while FIGS. 6 and 7 which show the details of how the sheet 32 is secured in place relative to the seat frame 42. In one embodiment, the sheet 32 is a single unitary sheet made of two sections of woven material secured together by heat sealing or other suitable methods. The sheet 32 consists of a front seat fabric section 34 and a rear seat fabric section 36 that is preferably about 15% to 20% more compliant than the front seat fabric section. As illustrated in FIG. 2, the boundary between the front and rear supporting sections extends across the width of the seat such that the boundary is substantially transverse with respect to the longitudinal axis of a person's thighs when seated in the chair. The difference in the weaving construction of the sheet 32 can be seen in FIG. 3 in which the front seat fabric section 34 contains many more threads per inch than that rear seat fabric section 36. Alternatively, the front seat fabric section 34 may be woven from fibres which are thicker and/or stronger than those used to form the rear seat fabric section 36.

In one preferred embodiment the sheet 32 is woven from polyester elastomeric fibres in which the front section 34 is made of a dual tension high resilient mesh and the rear section 36 is made of a less resilient mesh. The front section 34 has less tendency to stretch under load, and is thus less compliant, than the rear section 36. The sheet material 32 is fixed in place in the front seat frame 42 after being pre-stretched. This method of assembly will be described in more detail in connection with FIGS. 6 and 7.

In a preferred embodiment of the invention, the support portion of the seat comprises a single sheet 32 having a front support portion and a rear support portion, where the rear support portion is more compliant than the front support portion. However, in possible alternative embodiments, the support portion of the seat may be formed from more than one sheet 32.

Figure 11:
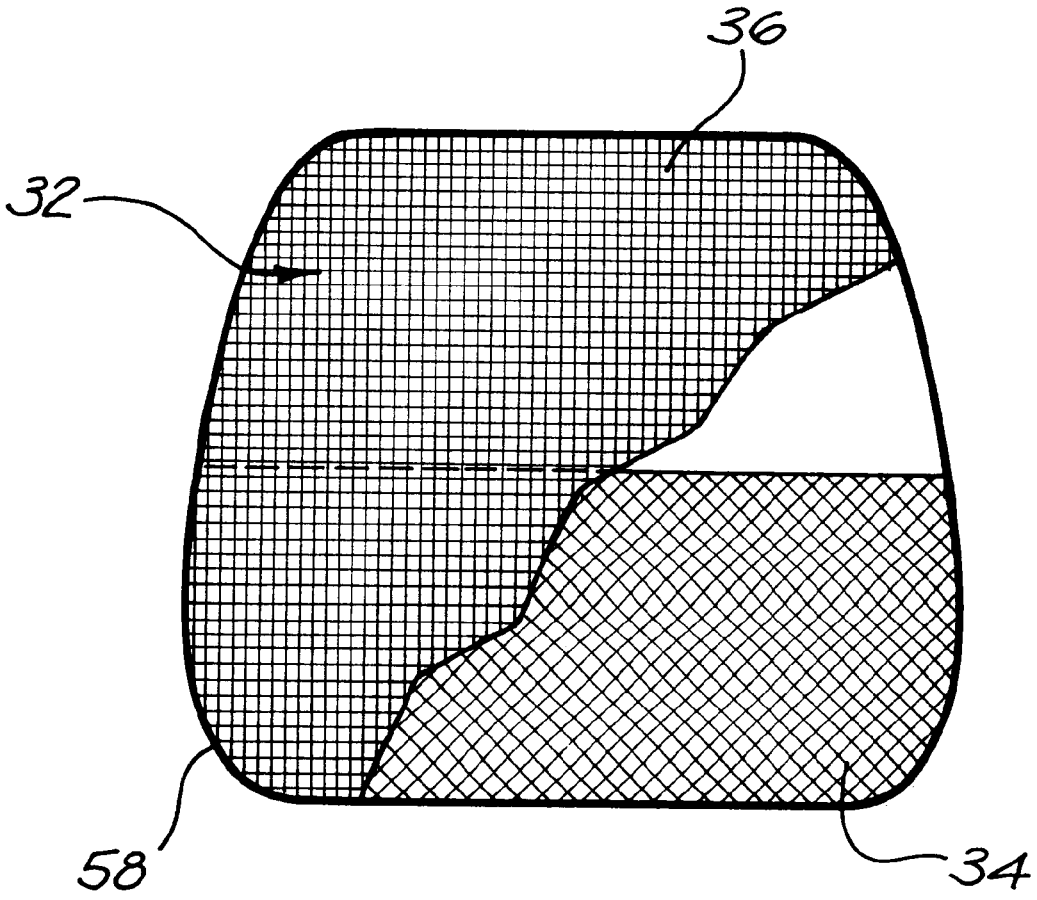
FIG. 11 illustrates an embodiment wherein the front support section of the seat comprises two or more overlying layers of sheet material whilst the rear support section of the seat comprises a single layer of sheet material.

For example, in an alternative embodiment of the invention illustrated in FIG. 11, the front section 34 of the seat may comprise two or more overlying layers of sheet material, whilst the rear section 36 comprises a single layer of sheet material. For example, the front section 34 may comprise a first layer of tensioned sheet material, over which is laid a further layer of sheet material which extends over both the front and rear portions of the seat. By producing the sheet material(s) from suitable materials and/or pretensioning, the front support portion can provide less compliance than the rear section 36.

The differing zones of resilience in the support portion of the seat can be created by varying the type of weave between the two zones, or by varying the type of material. Alternatively, the front portion of the seat may be tensioned to a greater extent than the rear portion of the seat so that it provides a higher resistance to resilient deformation.

Figure 4:
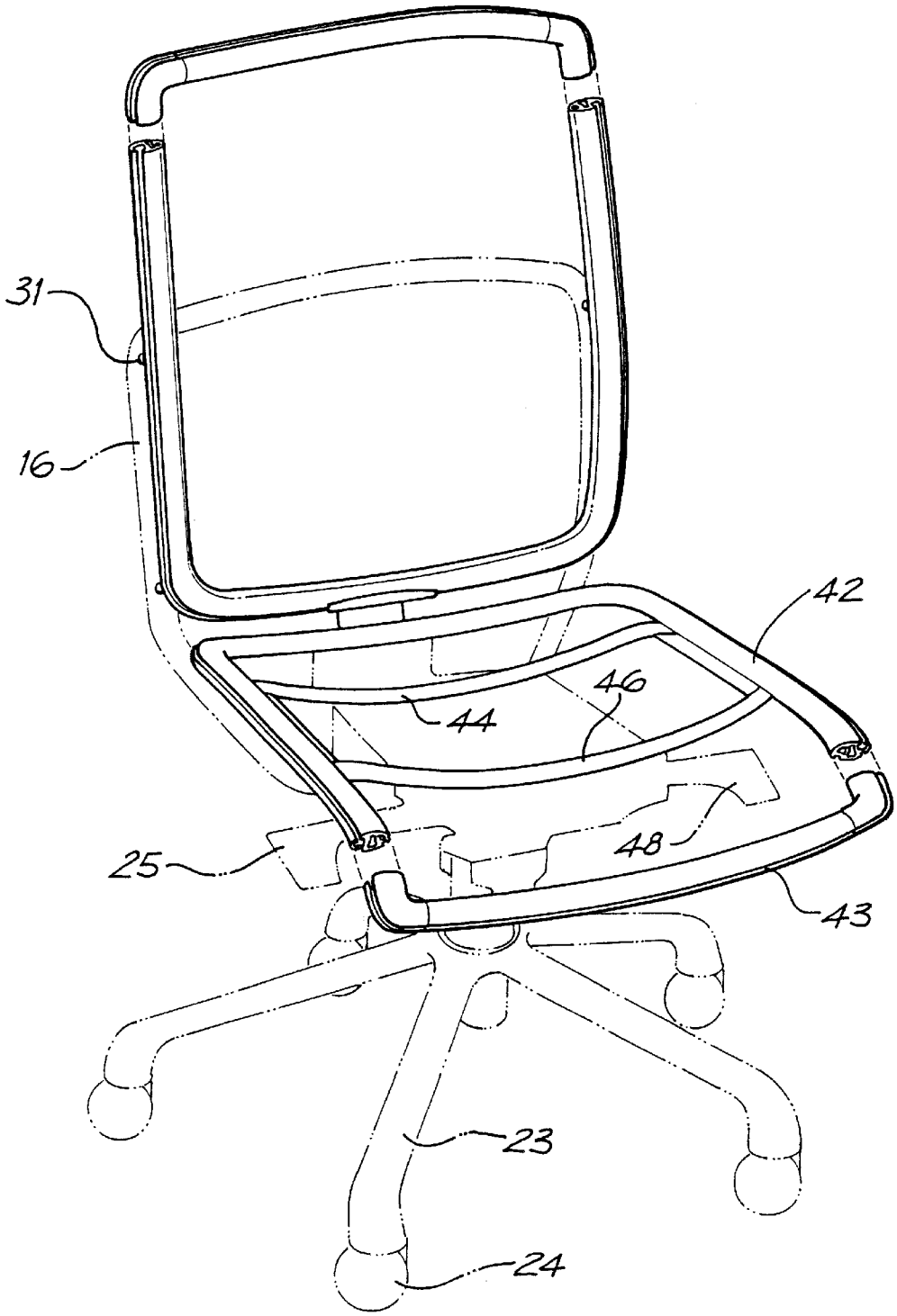
FIG. 4 illustrates the framing construction of the seat and back portion.

Referring to the seat construction it is seen from FIG. 4, the frame 42 is an extrusion formed from aluminum or aluminum alloy, that is generally U-shaped to which the fabric is tightly secured and this U-shaped extrusion is enclosed by an end piece 43. Support bars 44, 46 provide additional support for the seat frame 42.

In FIG. 4 there is also illustrated the synchronised back and seat angle adjustment 48. During this adjustment the back moves approximately twice that of the seat.

FIG. 5 illustrates in some detail the underseat construction of the chair including in addition to the aforementioned seat and back adjustments the support structure 50 for supporting the back assembly relative to the main underseat frame construction. It is also noted that the chair of FIG. 5 includes an adjustable arm support 52.

FIGS. 6 and 7 illustrate the attachment of the seat fabric to the seat frame section 42 in accordance with the present invention.

The frame section 42 is an extrusion of aluminum or aluminum alloy that is suitably secured to and supported by the seat frame members 44, 46. The extrusion 42 includes a longitudinally extending recess 56 in which the seat fabric is secured after it has been stretched the desired amount by a suitable machine which, by way of example only, includes a series of clamps that hold the fabric and then stretches the fabric to the desired length. The sheet 32 includes a bead 58 along at least a pair of opposing edges, the bead being located and retained in the recess 56 of the extruded section 42 so as to secure the sheet material in place relative to the frame. In a preferred embodiment, the bead 58 has a substantially round cross-sectional profile and is located in a seam which extends along at least a pair of opposing edges of the sheet 32. In a preferred embodiment, the bead 58 extends around the entire periphery of the sheet 32. The fabric is held in a stretching apparatus by means of a series of clamps and is then stretched to the extent that the bead 58 can be located in the recess 56. With the bead 58 located in the recess 56 a longitudinally extending retaining member 60 is pressed into the recess 56 to secure the bead 58 within the recess. The retaining member 60 has a substantially T-shaped cross-sectional profile including a tongue section 61 which is shaped and sized so as to locate within the recess 56 and retain the bead 58 in place. With the retaining member 60 pressed into the recess 56 the tongue section 61 seats against an inner face 63 of the recess and acts to locate and retain the bead 58 under a lip 62 of the recess 56. The combination of the tension in the sheet 32, the shape and size of the retaining member 60, the shape and size of the recess 56 and the subsequent force the bead exerts on the retaining member 60 acts to draw the bead 58 hard against the tongue 61 and retain the bead in the recess, thereby holding the sheet in place on the frame section 42. The T-shaped retaining member 60 also includes a head section 64 which, as illustrated in FIGS. 6 and 7, acts to cover the mouth of the recess 56 and provide a smooth outer surface around the periphery of the seat frame section 42 where the sheet is secured to the seat frame. Thus the sheet 32 in its extended stretched condition to form a seat which will support the occupant in the correct posture position while resisting forward movement of the sitter from the seat. This is accomplished by forming the sheet 32 with a front portion 34 that is more resistant to deformation than the rear portion 36.

Figure 8:
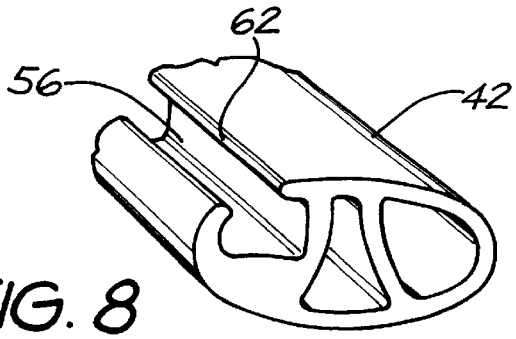
FIG. 8 is a perspective view of a cross-section of a length of the extrusion forming the seat frame.

FIG. 8 illustrates a cross-section of a length of the extruded section 42 which forms the seat frame member. The frame member 42 includes a recess 56 into which the bead of the sheet 36 is located. It is to be appreciated that the cross-sectional form of the frame member 42 and the recess 56 may vary.

Figure 9:
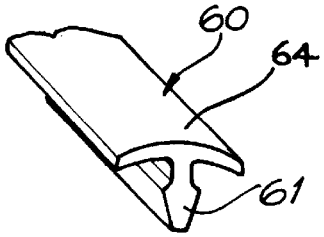
FIG. 9 is a perspective view of a length of one embodiment of the retaining member for retaining the fabric in position under tension.
Figure 10:
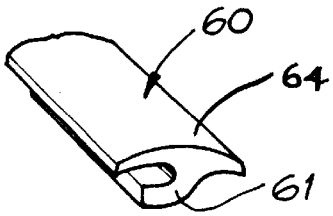
FIG. 10 is a perspective view of a length of a further embodiment of the retaining member.

FIGS. 9 and 10 illustrate a retaining member 60 used to retain the bead 58 within the recess 56. The retaining member 60 includes a tongue section 61 which is shaped and sized so as to locate within the recess and retain the bead 58 in the recess 56, and a head section 64 which covers the mouth of the recess 56. Preferably, the retaining member 60 has a substantially T-shaped cross-sectional profile, although as illustrated in FIGS. 9 and 10 the profile of the retaining member may take a variety of forms depending upon the respective size and shape of the recess 56 and the bead 58. Preferably, the retaining member is formed by extrusion and has a constant cross-sectional profile along its length. Preferably, the retaining member is extruded from a suitable polymer.

It remains to note that the arm rest 54 includes arm support openings 65 which provides for selective positioning of the arms relative to the seat. After the arm is properly positioned a fastener 66 is employed to secure the arm rest in place.

Although the invention has been described with reference to specific examples it will be appreciated by those skilled in the art that the invention may be embodied in many other forms.

What is claimed is:

1. A chair having a seat assembly for supporting a person sitting on the chair, the seat assembly including:

a seat frame;

sheet material that is stretched and secured in place relative to said frame to support a person sitting on the chair by tension forces in the sheet material;

said sheet material including a bead along an edge thereof, said seat frame including an extruded section with a recess into which said bead is located, said bead being secured in said recess by means of a retaining member so as to secure said sheet material under tension to said seat frame, wherein said retaining member is extruded and has a constant, substantially T-shaped cross-sectional profile including a tongue portion which is shaped and sized so as to locate within the recess and retain the bead in place in said recess.

2. A chair according to claim 1 wherein said section of said seat frame is extruded from aluminum.

3. A chair according to claim 1 wherein said tongue portion of said retaining member seats against an inner face of the recess and acts to locate and retain the bead under a lip of the recess.

4. A chair according to claim 1 wherein said retaining member includes a head section adapted to cover said recess.

5. A chair according to claim 1 wherein said retaining member is extruded from polymer material.

6. A chair according to claim 1 wherein said sheet material includes a bead along at least a pair of opposing edges, said bead being located and retained in said recess of said extruded section to secure said sheet material in place relative to said frame.

7. A chair according to claim 1 wherein said sheet material is woven.

8. A chair according to claim 7 wherein said sheet material is woven from polyester elastomeric fibers.

9. A chair according to claim 1 wherein said sheet material has a front support portion and a rear support portion, said front support portion being of relatively high resistance to resilient deformation and said rear support portion being of relatively low resistance to resilient deformation such that weight of the person sitting on the chair causes differential deformation of said front and rear support portions whereby said rear support portion is deformed to a greater extent than said front support portion, the differential deformation on the front and rear support portions acting to locate the person's ischial tuberosity behind the front support portion thereby resisting forward movement of the person from the chair and thus retaining the sitter in a correct seating position.

10. A chair according to claim 9 wherein said rear support portion is 15 to 20 percent more compliant than said front support portion.

11. A chair according to claim 9 wherein said front support portion is stretched to a greater extent than said rear support portion.

12. A chair according to claim 9 wherein said forward support portion and rear support portion are formed from a unitary sheet material.

13. A chair according to claim 9 wherein said sheet material is woven.

14. A chair according to claim 13 wherein said sheet material is woven from polyester elastomeric fibers.

15. A chair according to claim 13 wherein said front support portion has more fibers per inch than said rear support portion.

16. A chair having a seat assembly for supporting a person sitting on the chair, the seat assembly including:

a seat frame;

sheet material that is stretched and secured in place relative to said frame to support a person sitting on the chair by tension forces in the sheet material;

said sheet material including a bead along an edge thereof, said seat frame including an extruded section with a recess into which said bead is located, said bead being secured in said recess by means of a retaining member so as to secure said sheet material under tension to said seat frame, wherein said retaining member is extruded and has a constant, substantially T-shaped cross-sectional profile including a tongue portion which is shaped and sized so as to locate within the recess and retain the bead in place in said recess, said tongue portion seating against an inner face of the recess and acting to locate and retain the bead under a lip of the recess.

17. A chair member according to claim 16 wherein said retaining member includes a head section adapted to cover said recess.

18. A chair according to claim 16 wherein said sheet material has a front support portion and a rear support portion, said front support portion being of a relatively high resistance to resilient deformation and said rear support portion being of relatively low resistance to resilient deformation such that weight of the person sitting on the chair causes differential deformation of said front and rear support portions whereby said rear support portion is deformed to a greater extent than said front support portion, the differential deformation of the front and rear support portions acting to locate the person's ischial tuberosity behind the front support portion thereby resisting forward movement of the person from the chair and thus retaining the sitter in a correct seating position.

* * * * *